US005949442A

United States Patent [19]

Nishiyama

[11] Patent Number: 5,949,442

[45] Date of Patent: Sep. 7, 1999

[54] DISPLAY DEVICE IN WHICH DISPLAY INFORMATION IS SMOOTHLY SCROLLED

[75] Inventor: Masaki Nishiyama, Tokyo, Japan

[73] Assignee: Canon Kabushiki Kaisha, Tokyo, Japan

[21] Appl. No.: 08/218,299

[22] Filed: Mar. 28, 1994

Related U.S. Application Data

[63] Continuation of application No. 07/811,914, Dec. 23, 1991, abandoned, which is a continuation of application No. 07/390,501, Aug. 1, 1989, abandoned, which is a continuation of application No. 07/104,527, Oct. 1, 1987, abandoned, which is a continuation of application No. 06/664, 306, Oct. 24, 1984, abandoned.

[30] Foreign Application Priority Data

Oct. 31, 1983 [JP] Japan ..... 58-202670

[51] Int. Cl.[6] ..... G09G 5/34; G06F 13/00

[52] U.S. Cl. ..... 345/511; 345/196; 345/123

[58] Field of Search ..... 340/723, 724, 340/726, 748, 750, 792, 799

[56] References Cited

U.S. PATENT DOCUMENTS

| | | | |
|---|---|---|---|
| 3,581,290 | 5/1971 | Sugarman | 340/750 |
| 3,911,404 | 10/1975 | O'Neill, Jr. | 340/748 |
| 4,075,620 | 2/1978 | Passavant et al. | 340/750 |
| 4,079,458 | 3/1978 | Rider et al. | 345/201 |
| 4,196,430 | 4/1980 | Denko | 340/799 |
| 4,284,988 | 8/1981 | Seitz et al. | 340/726 |
| 4,342,991 | 8/1982 | Pope et al. | 340/792 |
| 4,399,435 | 8/1983 | Urabe | 340/750 |
| 4,400,697 | 8/1983 | Currie et al. | 340/748 |
| 4,408,200 | 10/1983 | Bradley | 340/750 |
| 4,418,344 | 11/1983 | Brown | 340/792 |
| 4,485,378 | 11/1984 | Matsui et al. | 340/750 |
| 4,496,976 | 1/1985 | Swarson et al. | 345/201 |
| 4,517,654 | 5/1985 | Carmean | 340/726 |
| 4,611,202 | 9/1986 | Di Nitto et al. | 345/123 |
| 4,642,794 | 2/1987 | Lavelle et al. | 340/726 |
| 4,649,379 | 3/1987 | Canton et al. | 340/748 |
| 4,710,762 | 12/1987 | Yamada | 345/201 |

FOREIGN PATENT DOCUMENTS

| | | | |
|---|---|---|---|
| 53-148233 | 12/1978 | Japan | 345/123 |
| 5544626 | 3/1980 | Japan | 340/726 |
| 2-094116 | 9/1982 | United Kingdom | 345/123 |

*Primary Examiner*—Lun-Yi Lao

*Attorney, Agent, or Firm*—Fitzpatrick, Cella, Harper & Scinto

[57] ABSTRACT

A display device to realize a smooth scroll on a display screen is provided. This device comprises: a memory having a plurality of storage parts which can store information to be displayed which is formed by a plurality of dot lines on a line unit basis; transfer circuit for transferring the information stored in the memory to a video memory on a unit basis of one dot line or a plurality of dot lines less the total contained in the above line unit; a timer for controlling the transfer of the information from the memory to the video memory; display apparatus for displaying the information in the video memory; and a controller for scrolling the information which is displayed on the display screen on the display apparatus.

23 Claims, 7 Drawing Sheets

| ADDRESS | 0H | 1H | 2H | 3H | 4H | 5H | 6H | 7H |
|---|---|---|---|---|---|---|---|---|
| DATA | 00H | 00H | 00H | 18H | 24H | 42H | 42H | 42H |
| 8H | 9H | AH | BH | CH | DH | EH | FH |
|---|---|---|---|---|---|---|---|
| 7EH | 42H | 42H | 42H | 00H | 00H | 00H | 00H |
FIG. 3-B
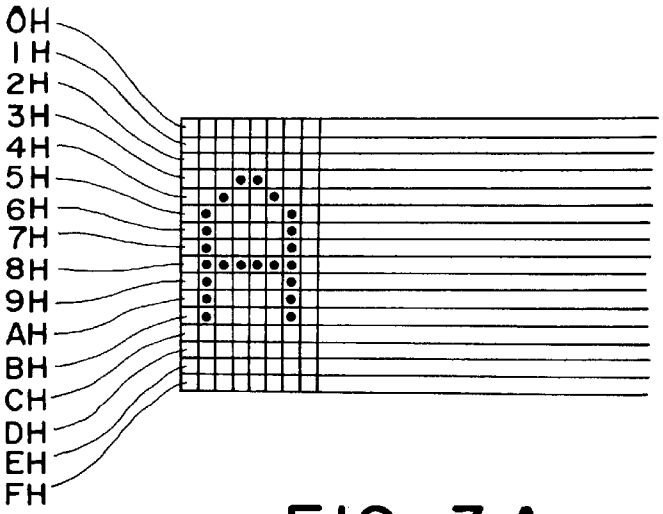
FIG. 3-A

DISPLAY DEVICE IN WHICH DISPLAY INFORMATION IS SMOOTHLY SCROLLED

This application is a continuation of application Ser. No. 07/811,914, filed Dec. 23, 1991, which is a continuation of application Ser. No. 07/390,501, filed Aug. 1, 1989, which is a continuation of application Ser. No. 07/104,527, filed Oct. 1, 1987, which is a continuation of application Ser. No. 07/664,306, filed Oct. 24, 1984, all abandoned.

BACKGROUND OF THE INVENTION

1. Field of the Invention

The present invention relates to a display device for displaying dot information and more particularly to a display device having a scrolling function.

2. Description of the Prior Art

Conventionally, in CRT display devices of the dot refresh type, a character pattern (hereinbelow, abbreviated as a font) which is displayed for every character is directly transferred to a memory called a video RAM (hereinbelow, abbreviated as a VRAM) and a bit pattern in the VRAM is displayed on a CRT through a CRT controller. Thus, the next character can be displayed only after the display of one character line has been completed. Therefore, in case of scrolling a screen upwardly, the scroll is performed while producing a blank line at the bottom portion of the screen and after scrolling is completed, a character string which should be displayed is indicated in the blank line.

However, in order to start the display of a character string after scrolling is completed as mentioned above, it takes a longer time to display characters of one line and the scrolling is stopped during this interval. Due to this, the scrolling is not performed smoothly in spite of the dot refresh type CRT. The following technology can be considered to solve such a problem and realize smooth scrolling.

Namely, the number of bits in the VRAM is set to be one line larger than the number of bits which can be actually displayed on the CRT; a character string which should be displayed next is preliminarily produced in the above-mentioned one extra line by use of the foregoing technology; this is supported by an intelligent CRT controller, thereby accomplishing smooth scrolling. However, the CRT controller for this purpose is complicated because of the scrolling function and the total cost of the apparatus is high.

SUMMARY OF THE INVENTION

It is an object of the present invention to eliminate the above-mentioned drawback in consideration of the above-mentioned point.

Another object of the invention is to realize a smooth scrolling with a simple hardware constitution by use of an inexpensive CRT controller in consideration of the foregoing point.

Still another object of the invention is to provide a display apparatus comprising: storing means having a plurality of storage parts for storing display information on a predetermined unit basis; means for transferring the image information to the VRAM on a unit basis which is smaller than the above predetermined unit; and control means for controlling the storing means and transferring means so as to execute smooth scrolling on a display screen in consideration of the foregoing.

A further object of the invention is to provide a display apparatus including an instructing means for instructing a paragraph change in the display information, wherein a CPU is interrupted on the basis of an instruction from the instructing means and in response to a timing signal from a timer and wherein the display information is transferred from the RAM to the VRAM on a line unit basis consisting of one or a plurality of dots, thereby performing the scrolling operation on the display screen in consideration of the foregoing.

A still further object of the invention is that: the display information is stored in the RAM on a predetermined unit basis; the display information is transferred from the RAM to the VRAM; and the scrolling on the display screen by the VRAM is performed on a unit basis which is smaller than the above-mentioned predetermined unit in consideration of the foregoing.

BRIEF DESCRIPTION OF THE DRAWINGS

FIG. 3A is a diagram showing a character font;

FIG. 3B is a diagram showing the correspondence between the address and the data;

DETAILED DESCRIPTION OF THE PREFERRED EMBODIMENT

One embodiment of the present invention will now be described in detail hereinbelow with reference to the drawings.

The CRT controller for displaying a bit pattern image of the VRAM on the CRT is the same as that in the conventional technology, so that its description is omitted. It is now assumed for convenience that the bit pattern in the VRAM unconditionally corresponds to the dot pattern on the CRT. In the following description, a numeral to which "H" is added as a suffix denotes a hexadecimal numeral.

Figure 1:
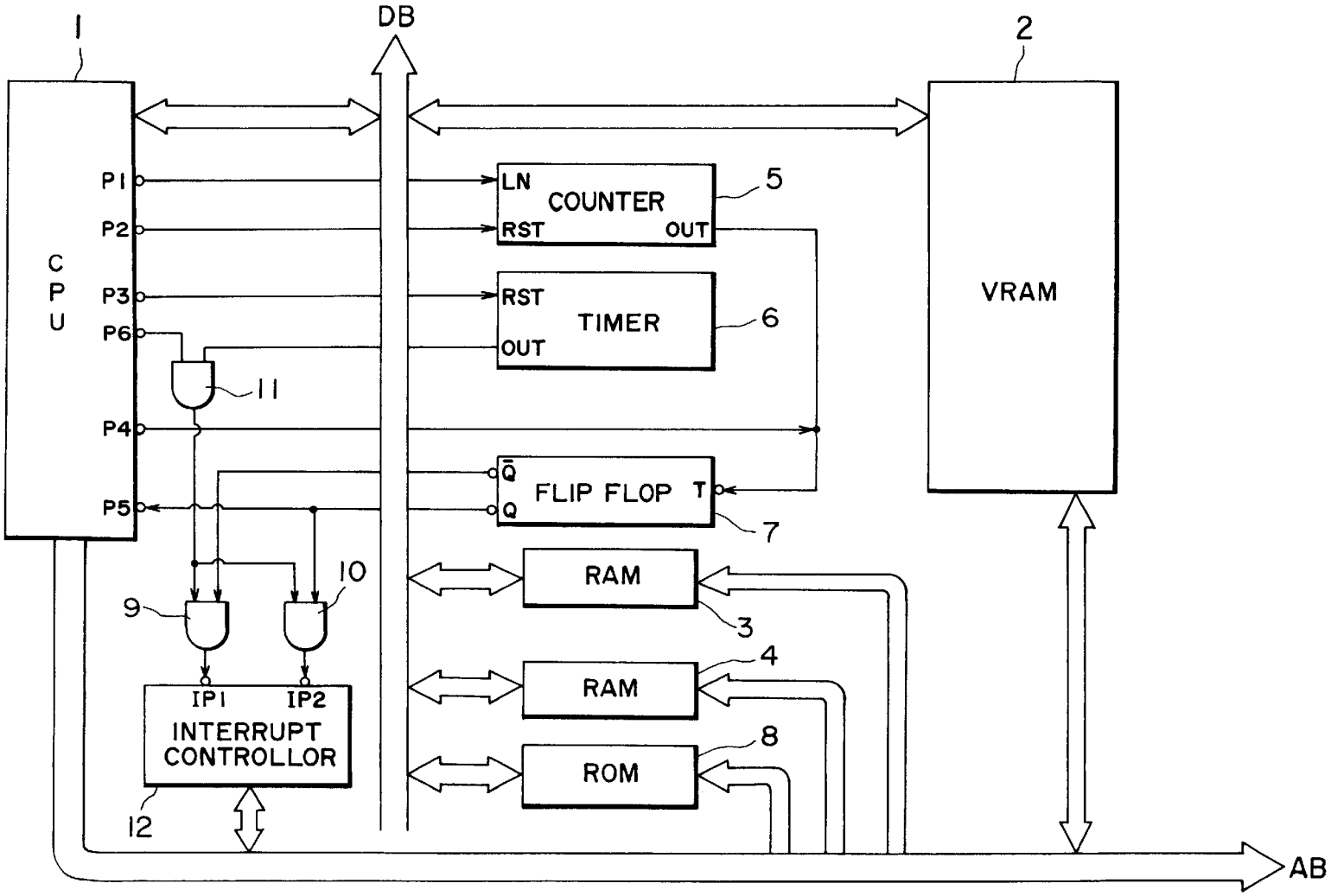
FIG. 1 is an arrangement diagram showing a display device according to the present invention.

FIG. 1 is an arrangement diagram showing a display apparatus of one embodiment according to the present invention, this display apparatus can be connected to word processing equipment such as, for example, a typewriter, a word processor or the like. In the diagram, a reference numeral 1 denotes a central processing unit (hereinbelow, abbreviated as a CPU) for performing various kinds of processings; 2 is a VRAM; 3 and 4 random access memories (hereinbelow, abbreviated as RAMs); 5 a counter; 6 a timer; 7 a T-type flip flop; 8 a read only memory (hereinbelow, abbreviated as an ROM) in which control and font patterns for use in the present invention are stored; 9, 10 and 11 AND circuits; 12 an interrupt controller; DB a data bus; and AB an address bus. Obviously, in addition to the above parts and components, a scroll instructing key and the like of the word processing equipment main body may be connected.

Figure 4B:
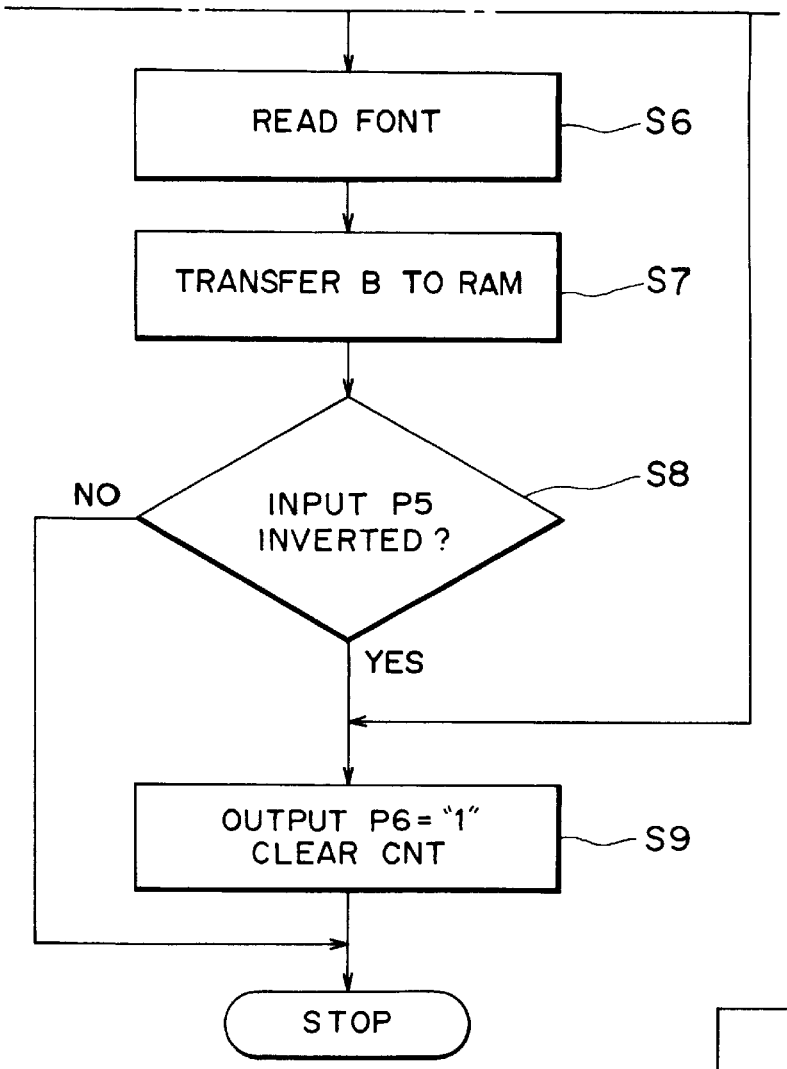
FIG. 4 is a connection layout of FIGS. 4A and 4B which comprise a flow chart showing a character processing.
Figure 4:
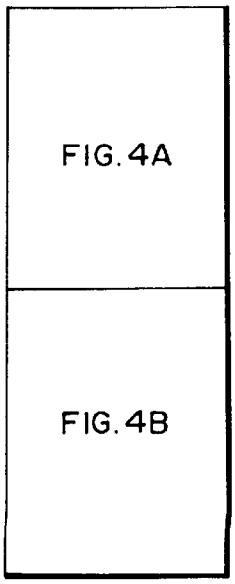
Figure 4A:
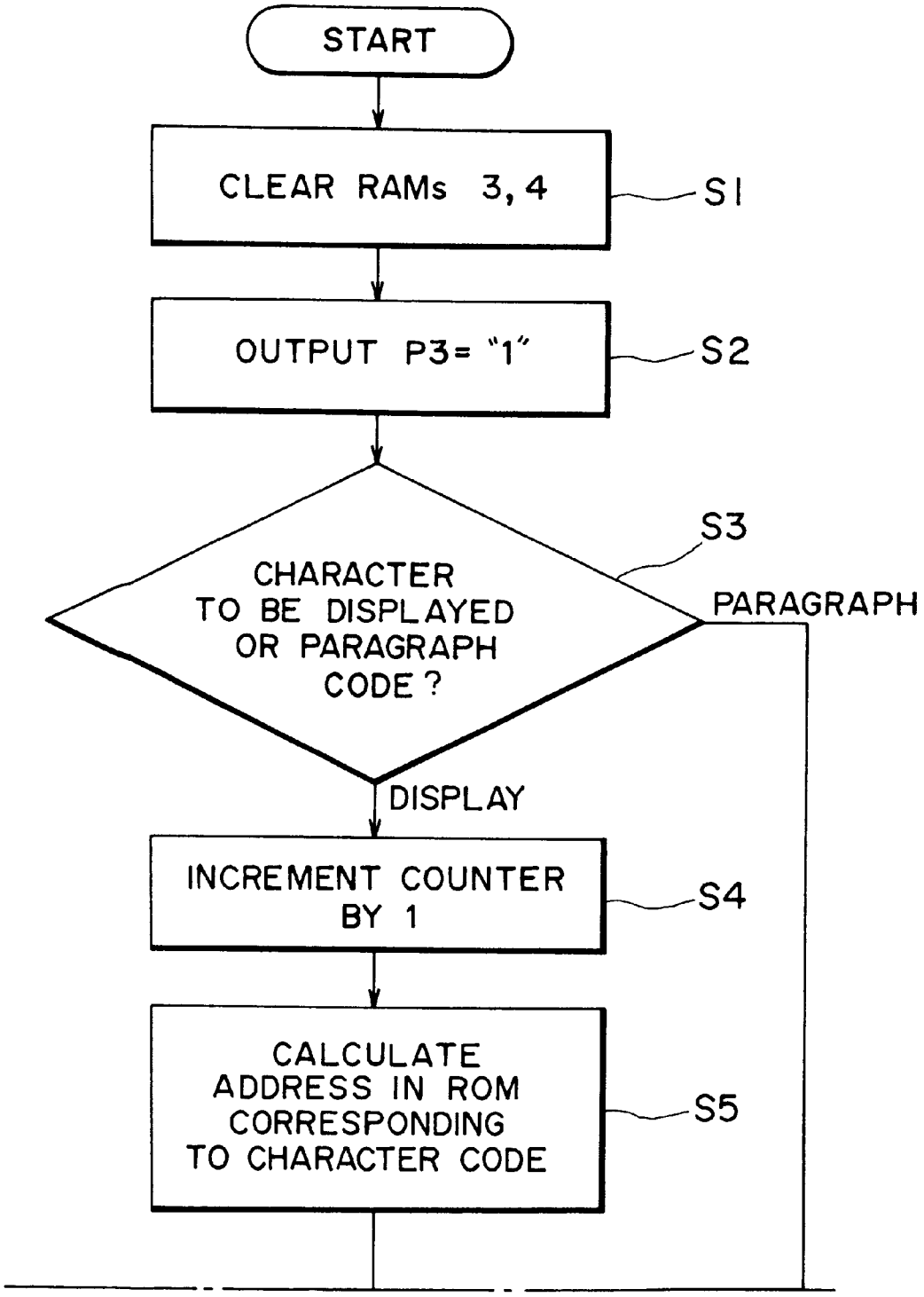
Figure 5:
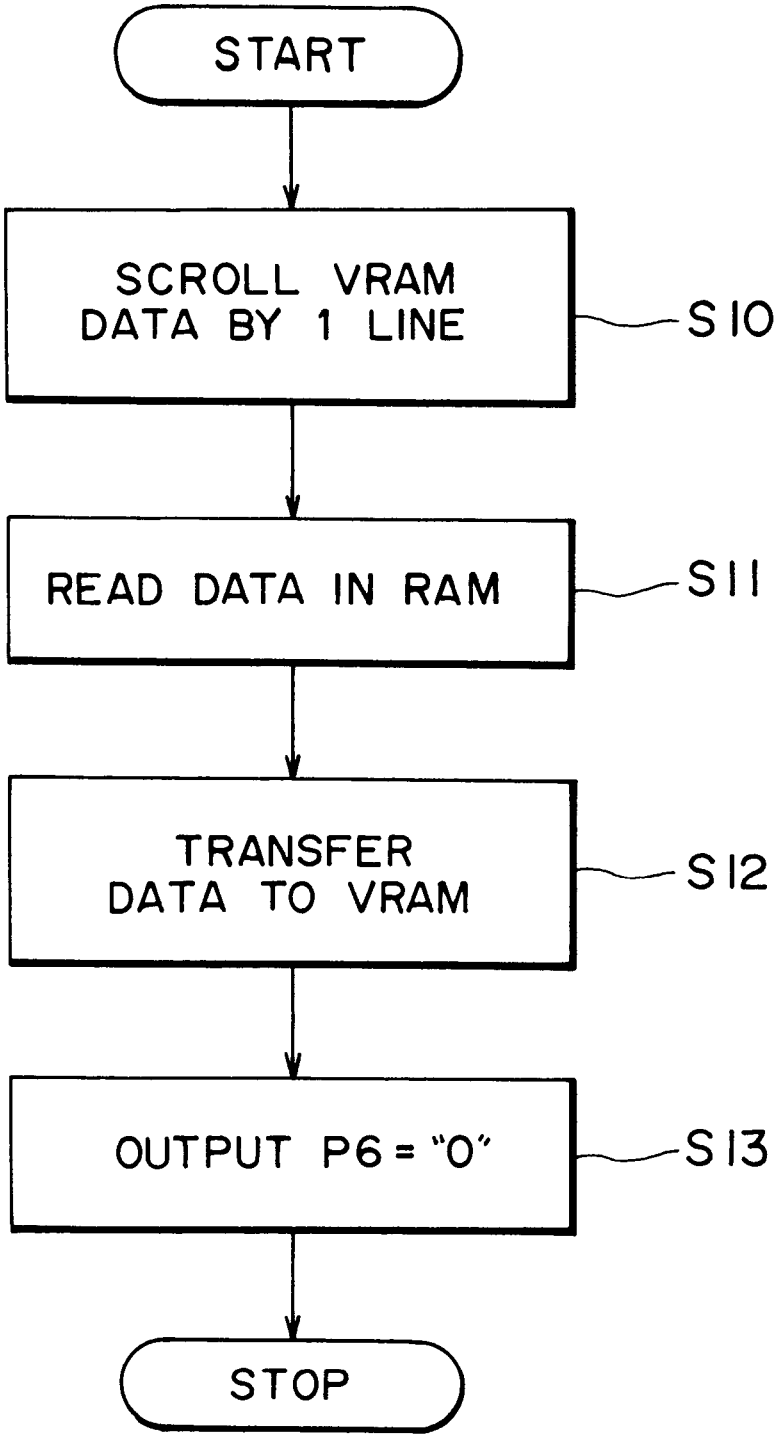
FIG. 5 is a simple flow chart showing a data transfer from the RAM to the VRAM.

FIGS. 4A and 4B illustrate a schematic process flow chart on a display character unit basis in the embodiment. FIG. 5 shows a transfer flow chart for transferring the font pattern developed in the RAM to the VRAM.

In the display device of the embodiment, the CRT having 640 dots in the horizontal direction and 400 dots in the vertical direction is used, and a size of font is eight dots in the horizontal direction and sixteen dots in the vertical direction. Therefore, 2000 characters can be displayed on the CRT. One bit in the VRAM 2 corresponds to one dot on the CRT, so that it is necessary for the VRAM 2 to have the size of 640×400÷8=32000 (bytes). In addition, each size of the RAMs 3 and 4 is 18×16×80÷8=1280 (bytes), so that data of one line can be stored. The counter 5 counts up by ones from 0 in response to a logic "1" which is generated from an output P1 of the CPU 1. When a count value of the counter 5 becomes 81 corresponding to one line, the counter outputs a signal to the flip flop 7 and the internal counter is reset to 0.

The timer 6 inputs a logic "1" from an output P3 of the CPU 1 as a reset signal and outputs a logic "1" to the AND circuit 11 at a constant time interval. The flip flop 7 inverts outputs Q and $\overline{Q}$ whenever a pulse is inputted to an input T.

With such an arrangement, two thousand characters are displayed on the CRT display.

In case of further displaying the 2001st character, it is necessary to scroll on the CRT screen. However, at this time, the 2002nd to 2080th characters which should be displayed are not determined. Therefore, conventionally, one line (corresponding to the number of dots in the vertical direction of a font) is scrolled to produce a blank line (corresponding 80 characters) in the lowest line of the screen, and the CRT screen is set into the state whereby only 1920 characters are displayed, thereafter, the 2001st character is displayed.

On the other hand, according to the present invention, the scroll is not performed at the time of display of the 2001st character, but a font is temporarily developed in the RAM 3 or RAM 4, then the font is transferred to the VRAM 2 after the elapse of a constant time.

In FIG. 4, steps S1 and S2 are performed as an initial processing. First, in step S1, the RAMs 3 and 4 are cleared. In next step S2, the CPU 1 sets the output P3 to a logic "1" to start the timer 6. The timer 6 receives this signal as a reset signal and starts operating. However, the output from the timer 6 at this time is cut by the AND circuit 11. The timer 6 serves to transfer the data by one dot line at a time from the RAM to the VRAM at every 17.44 msec at a constant period. Then, in step S3, a check is made to see if the data is a character to be displayed or another data such as, for example, a paragraph code. In case of the paragraph code, the process routine advances to step S9. If it is not the paragraph code, that is, in case of a character to be displayed, the CPU sets the output P1 to a logic "1" to increase the counter by 1 in next step S4, thereafter the CPU resets to a logic "0". Due to this, the content of the counter 5 is increased by only 1.

In next step S5, a head address of the font in the ROM 8 corresponding to the 2001st character code to be displayed is calculated. For instance, the font of a character "A" such as shown in FIG. 3A is stored in each address in the ROM 8 as a data such as shown in FIG. 3B.

Figure 2:
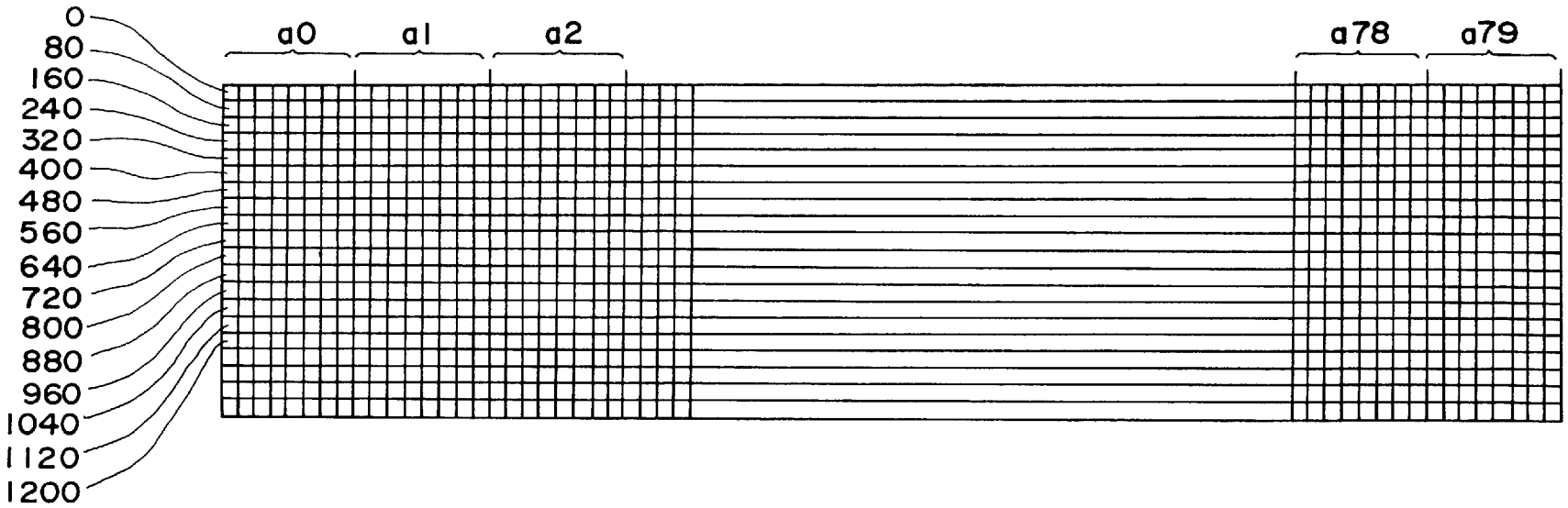
FIG. 2 is a constitutional diagram of a RAM of FIG. 1.

Then in step S6, the data of 16 bytes which is the data of one character is read out from the addresses of the font calculated in step S5 (these 16 bytes are referred to as B0, B1, . . . , B15, respectively). The RAM 3 for storing the data read out has an arrangement shown in FIG. 2. In step S7, the byte B0 is transferred to the address 0 in a region a0 in the RAM 3; the byte B1 is transferred to an address 80 in the region a0; the subsequent bytes are sequentially transferred in a similar manner; and the last byte B15 is transferred to the address 1200 in the region a0 (namely, the byte Bn is transferred to the address n×80). Then, step S8 follows. In this case, since the P5 input is not inverted, the answer in step S8 is "No" and the process routine directly advances to "END".

With respect to the 2002nd to 2080th characters as well, the similar processings as steps S4 to S7 are performed until the paragraph code is received (it can be easily understood that, for instance, the 2002nd font may be stored in a region al in the RAM 3 at every 80-byte interval and the 2003rd font may be stored in the region a2 at every 80-byte interval).

As described above, font patterns are sequentially formed in the RAM 3. When the paragraph code is received, the process routine advances from step S3 to step S9 and the CPU 1 carries out the following processings.

1) Sets an output P2 which is outputted to the counter 5 into a logic "1" and resets the counter 5.
2) Sets an output P4 into a logic "1" to change over the output of the flip flop 7, and thereafter returns the output P4 to a logic "0".

An input P5 of the CPU 1 is set to a logic "1" by this step S9. Even in the case where no paragraph code exists in the 2001st to 2080th characters, the output from the counter 5 becomes a logic "1" since a pulse is inputted to the flip flop 7 by counting the data of one line, so that the input P5 of the CPU also becomes a logic "1". When the input P5 is a logic "1", the CPU 1 executes steps S4 to S7 with regard to the RAM 3. On the other hand, when the P5 is a logic "1", the CPU executes the same processings as in steps S4 to S7 with respect to the RAM 4. In step S9, the counter CNT for transferring the data of one line to the VRAM which will be mentioned later is cleared.

I In step S8, the CPU 1 checks the input P5 to see if it changes from a logic "0" to "1" or from "1" to "0" by detecting the above-mentioned paragraph code or counting up the counter. In the case where the input P5 changes, step S9 follows, then an output P6 is set into a logic "1" in order to interrupt the CPU 1 and transfer the data to the VRAM 2 as described above.

The character pattern produced in the RAM 3, on the other hand, is transferred to the VRAM 2 in the manner as follows.

First, the output from the timer 6 is the input to the AND circuit 11 and the output P6 of the CPU 1 is a logic "1" in step S9; thus, the AND circuit 11 is satisfied by the output from the timer and the output P6. Since the output from the AND circuit 11 becomes the inputs to the AND circuits 9 and 10, the AND circuit 10 is satisfied (in the case where an output Q of the flip flop 7 is a logic "1"). An input IP2 of the interrupt controller 12 becomes a logic "1" in response to the output from the AND circuit 10, so that the interrupt controller 12 exerts a predetermined interruption to the CPU 1.

The CPU 1 carries out the processings shown in FIG. 5 as the interrupt processing to the IP2.

First, in step S10, the data in the VRAM 2 is scrolled up by one dot line in the lowest line of the screen. It takes about 10 to 20 msec. for this scroll. Next, in step S11, the data of one dot line stored in the RAM 3 is read out sixteen times, that is, the data of one line is read out. This data read out is transferred to the VRAM 2 sixteen times for every dot line in step S12. In step S13, the output P6 is set into "0" in order to turn off the AND gate 11 and turn off the interruption to the IP2, then the processing is finished.

In this interrupt processing, the data of the addresses 0 to 79 in the RAM 3 is transferred to the VRAM 2 at the first time.

The interruption at the second time occurs after the elapse of a preset time of the timer 6 and the data of the addresses 80 to 159 in the RAM 3 at this time is transferred to one dot line of the blank in the VRAM 2.

In the similar manner as above, the data of the addresses 80×(n−1) to 80×(n−1)+79 in the RAM 3 is transferred to one dot line of the blank in the VRAM 2 in case of the interruption at the n times (1≦n≦16).

Namely, the data is transferred from the RAM 3 to the VRAM 2 on a 80-byte unit basis for every interruption from the timer 6. Therefore, the scroll screen is scrolled one dot line by one at every constant time interval.

It should be noted that since the character string to be displayed next has already been produced in the RAM 4 at the time when one vertical line, namely, 16 dots were completely scrolled, at the time of the 17th interruption (first interruption to the RAM 4), by performing the same interrupt processing as that mentioned above with respect to the RAM 4 as the interrupt processing to the input IP1 of the interrupt controller 12, one dot line of the immediately next line is displayed also after the scrolling of one line (16 dots) and it takes a time between the lines, so that the scroll is smoothly executed.

As the final processing of the interrupt processing, the CPU 1 sets the output P6 to a logic "0". This is done for prevention of occurrence of the interruption in the scroll of the screen before the fonts are completely developed in the RAM 3 or 4.

Figure 6:
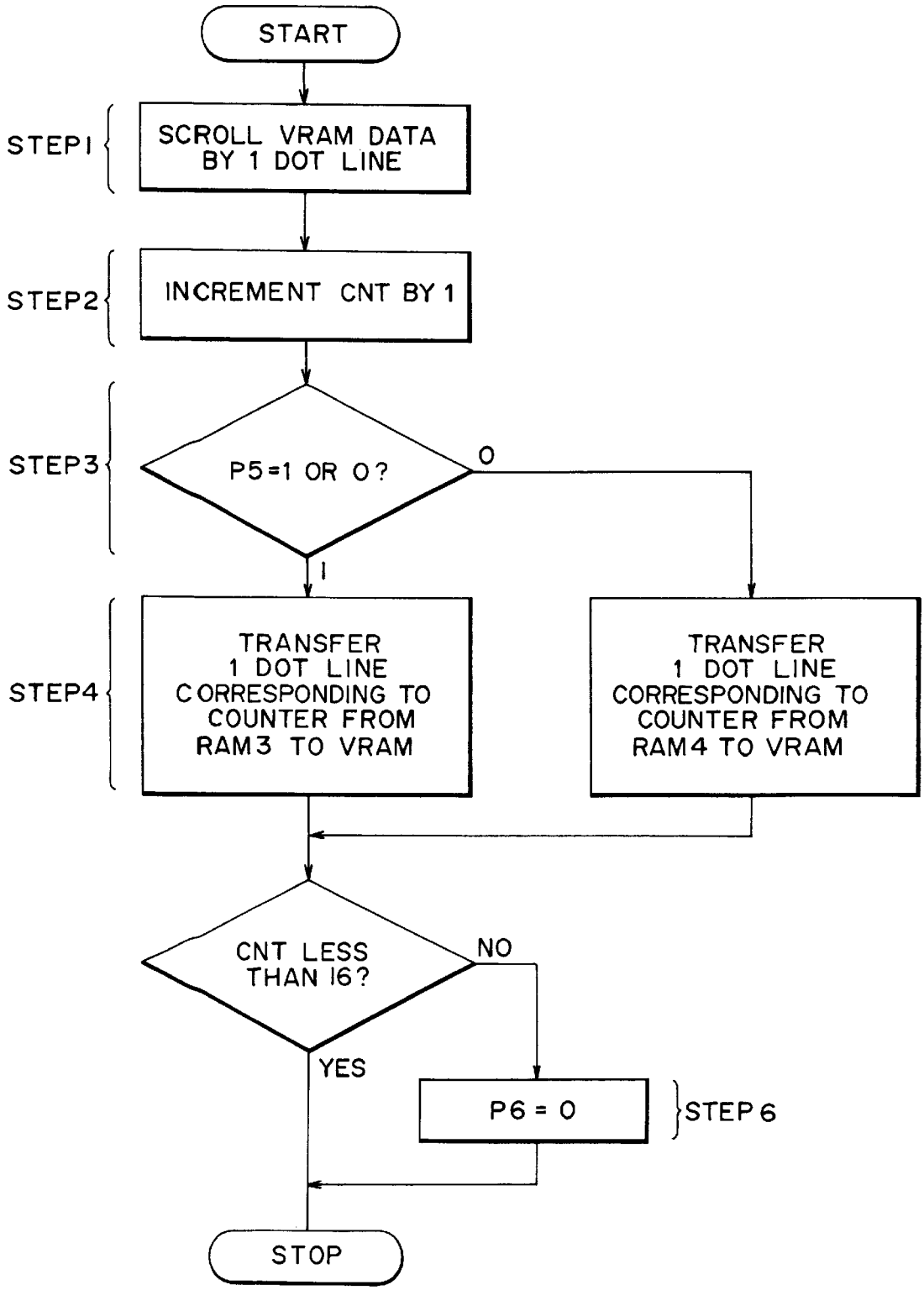
FIG. 6 is a detailed flow chart of FIG. 5.

FIG. 6 shows a detailed diagram of a flow chart of FIG. 5. In the case where the interruption to transfer the data from the RAM to the VRAM occurs, the data in the VRAM is scrolled upwardly by one dot line on the display screen in step 1 in FIG. 6. Then, a counter CNT corresponding to the dot line is increased by +1 in step 2.

Next, in step 3, the input P5 is checked to see if it is 0 or 1 as shown in FIG. 1 and in step S8 in FIG. 4. When it is determined that the P5 is 1 in step 3, the data of one dot line corresponding to the CNT is transferred in step 4 to the VRAM from the RAM 3 of which the storage has already been completed since the data from the ROM is being stored in the RAM 4 as described in conjunction with FIG. 4. On the contrary, when the P5 is 0, since the data from the ROM is being stored in the RAM 3 as described in FIG. 4, the data of one dot line corresponding to the CNT is transferred from the RAM 4 to the VRAM in the similar manner as described above. Then, in step 5, a check is made to see if the value of the counter CNT is less than 16 or not. That is, in case of CNT=5, since the fifth dot line among the 16 dots of one line in the vertical direction is transferred from the RAM to the VRAM, the process routine advances to "STOP" as it is and the sixth dot line is transferred to the VRAM by the next interruption. In the case where CNT becomes 15 or more, since the transfer of the data of one line from the RAM to the VRAM 2 is finished, the P6 is set to 0 in step 6 so as to prevent the occurrence of interruption due to the next time-up of the timer 6.

What we claim is:

1. A display device comprising:

display means for displaying a plurality of lines of information;

first memory means for storing a plurality of lines of information in a dot format including a plurality of dot lines;

second memory means for storing a plurality of dot lines of information in a dot format corresponding to the dot format of said dot lines stored in said first memory means;

first control means for writing one dot line of information into said second memory means, with said first control means, when information to be displayed is provided to said second memory means, converting the information into information of a dot format and storing the converted information into said second memory means;

discrimination means for discriminating whether or not one dot line of information stored in said second memory means is to be shifted to said first memory means;

second control means for shifting the plurality of lines of information stored in said first memory means, one dot line of information by one dot line of information, according to the discrimination of said discrimination means; and third control means for writing one dot line of information written into said second memory means into said first memory means after a shifting operation of said second control means.

2. A display device according to claim 1, further comprising a timer circuit for counting times at which each dot line is output to said display means.

3. A display device comprising:

display means for displaying a plurality of lines of information;

information data memory means for storing information data in a dot format including a plurality of dot lines, said information data being used to form each line of information to be displayed;

a plurality of memory means each for storing one line of information to be displayed by said display means, said one line of information being formed by using a plurality of dot lines in a dot format corresponding to the dot format of said dot lines stored in said information data memory means;

first control means for writing one dot line of information into said plurality of memory means, with said first control means, when information to be displayed is provided to said plurality of memory means, converting the information into information of a dot format and storing the converted information into said plurality of memory means;

discrimination means for discriminating whether or not one dot line of information stored in said plurality of memory means is to be shifted to said first information data memory means;

second control means for shifting said plurality of lines of information stored in said information data memory means, one dot line by one dot line, according to the discrimination by said discrimination means; and third control means for writing one dot line of information written into said plurality of memory means into said information data memory means after a shifting operation of said second control means.

4. A display device according to claim 3, further comprising a timer circuit for counting times at which each dot line is output to said display means.

5. A display device according to claim 3, further comprising indicating means for indicating that said information has been stored in each of said plurality of memory means, wherein upon indication by said indicating means, said discriminating means reads out said information stored in said plurality of memory means.

6. A display device according to claim 5, wherein said information consists of character information, and said indicating means includes a counter for counting the number of characters in said character information, and a paragraph code detecting circuit for detecting a paragraph code within said character information, and wherein said indicating means outputs a signal indicating that said character information has been stored in each of said plurality of memory means, when said counter has counted the number of characters in said character information or when said paragraph code detecting circuit has detected said paragraph code.

7. A display control apparatus for scrolling display contents of a display device displaying information of a plurality of lines, comprising:

designation means for designating a scroll display;

a display memory for storing information in a dot format including a plurality of bit lines;

a first buffer for storing information of a plurality of new bit lines in a dot format corresponding to the dot format of said bit lines stored in said display memory;

first control means for writing one dot line of information to be displayed into said first buffer according to the designation of said designation means, with said first control means converting the information to be displayed into one dot line of information of the dot format in response to the designation and storing the converted information into said first buffer;

discrimination means for discriminating whether or not one dot line of information, stored in said first buffer, is to be shifted to said display memory;

second control means for shifting said plurality of lines of information stored in said display memory, one dot line by one dot line, according to the discrimination of said discrimination means; and third control means for writing one dot line of information written into said first buffer into said display memory after a shifting operation of said second control means.

8. An apparatus according to claim 7, wherein said first buffer is a bit-map memory.

9. An apparatus according to claim 7, wherein said display memory is a bit-map memory.

10. An apparatus according to claim 7, wherein said second control means includes means for continuously repeating shifting of one bit line a plurality of times.

11. An apparatus according to claim 7, further comprising a second buffer for storing a plurality of new bit lines.

12. An apparatus according to claim 11, further comprising connection means for alternately connecting said first buffer and said second buffer to said display memory.

13. A display control method, comprising steps of:

storing information in a dot format including a plurality of bit lines in a display memory;

designating a scroll display;

storing information of a plurality of new bit lines in a first buffer according to the designation in a dot format corresponding to the dot format of the bit lines stored in the display memory;

determining whether or not the information of a plurality of new bit lines, stored in the first buffer, is to be shifted to the display memory;

after storing the information of the plurality of new bit lines in the first buffer, scrolling the information of the plurality of lines by one bit line and transferring contents of one bit line of the information stored in the display memory;

transferring the information of the plurality of new bit lines to the display memory from the first buffer; and displaying the information of the plurality of lines of the display memory.

14. A method according to claim 13, wherein said scrolling and transferring step is repeated.

15. A method according to claim 13, wherein said scrolling and transferring step transfers one bit line of a second buffer to the display memory after one bit line of the first buffer is transferred.

16. A display control apparatus, comprising:

designation means for designating a scroll display;

a display memory for storing information in a dot format including a plurality of bit lines;

a first buffer for storing information of a plurality of new bit lines in a dot format corresponding to the dot format of said bit lines stored in said display memory;

first control means for deciding whether the information of the plurality of new bit lines stored in the first buffer is to be shifted in said display memory according to the designation of said designation means, and if said information is to be shifted, for scrolling the information of a plurality of bit lines in said display memory;

second control means for, after said information of the plurality of bit lines is scrolled in said display memory, transferring contents of one but line of said first buffer to said display memory to scroll display contents by one bit line; and a display for displaying the information of the plurality of line stored in said display memory.

17. An apparatus according to claim 16, wherein said first buffer is a bit-map memory.

18. An apparatus according to claim 16, wherein said display memory is a bit-map memory.

19. An apparatus according to claim 16, wherein said second control means includes means for continuously repeating the scroll of one bit line.

20. An apparatus according to claim 19 further comprising a second buffer for storing a plurality of new bit lines.

21. An apparatus according to claim 20, further comprising connection means for alternately connecting said first buffer and said second buffer to said display memory.

22. An electronic device, comprising:

designation means for designating a scroll display of one line of information;

a display memory for storing information in a dot format including a plurality of bit lines;

a buffer for storing information of a plurality of new bit lines in a dot format corresponding to the format of said bit lines stored in said display memory;

first control means for deciding whether the information of the plurality of new bit lines stored is to be shifted in said display memory according to the designation of said designation means, and if said information of the plurality of new bit lines is to be shifted, for scrolling the information of a plurality of bit lines in said display memory;

second control means for, after the information of the bit lines is scrolled in said display memory, repeatedly transferring contents of one bit line of said buffer to said display memory to transfer the information of the new bit lines to said display memory so that displayed contents are scrolled by a plurality of bit lines; and a display for displaying the information of the plurality of lines of said display memory.

23. An electronic device, comprising:

designation means for designating a scroll display of one line of information;

a display memory for storing information in a dot format including a plurality of bit lines;

a buffer for storing information of a plurality of new bit lines in a dot format corresponding to the dot format of said bit lines stored in said display memory;

first control means for developing character information into a bit pattern of information of bit lines according to the designation of said designation means and causing said buffer to store the information of the new bit lines;

second control means for determining whether or not the bit pattern of information of bit lines is to be shifted;

third control means for shifting the information of the plurality of bit lines in said display memory;

fourth control means for, after the information of the plurality of bit lines is shifted in said display memory, repeatedly transferring contents of one bit line of said buffer to said display means to transfer the information of the new bit lines to said display memory so that the displayed contents are scrolled by a plurality of bit lines; and fifth control means for displaying the information of the plurality of lines of said display memory.

* * * * *

UNITED STATES PATENT AND TRADEMARK OFFICE

CERTIFICATE OF CORRECTION

PATENT NO. : 5,949,442

DATED : September 7, 1999

INVENTOR(S): MASAKI NISHIYAMA

It is certified that error appears in the above-identified patent and that said Letters Patent is hereby corrected as shown below:

On the title page, Item

[57] ABSTRACT:

Line 7, "less" should read --less than--.

COLUMN 4:

Line 23, ""1"," should read --"0",--.
Line 29, "I In" should read --In--.

COLUMN 6:

Line 61, "discriminating" should read --discrimination--.

COLUMN 8:

Line 22, "but" should read --bit--.
Line 26, "line" should read --lines--.

Signed and Sealed this

Twenty-fourth Day of October, 2000

*Attest:*

Q. TODD DICKINSON

*Attesting Officer*

*Director of Patents and Trademarks*